United States Patent [19]

Thompson

[11] 3,960,156

[45] June 1, 1976

[54] QUICK HAIR END WRAP FOR PERMANENT WAVE

[76] Inventor: Russell L. Thompson, 2900 Alta Vista Drive, Newport Beach, Calif. 92660

[22] Filed: Sept. 9, 1974

[21] Appl. No.: 504,196

[52] U.S. Cl. ..... 132/31 R; 132/42 R; 132/38 R

[51] Int. Cl.[2] ..... A45D 2/00

[58] Field of Search ..... 132/31 R, 36, 40, 42 R, 132/43, 43.1, 39, 41 R, 43 R, 38 R

[56] References Cited

UNITED STATES PATENTS

| | | | |
|---|---|---|---|
| 2,631,593 | 3/1953 | Madore | 132/38 R |
| 2,760,499 | 8/1956 | Taylor | 132/43 R |
| 2,874,706 | 2/1959 | Ficicchy | 132/42 R |
| 2,966,913 | 1/1961 | Lerner et al. | 132/41 R |
| 2,985,176 | 5/1961 | McKuwen et al. | 132/42 R |
| 3,388,709 | 6/1968 | Morris | 132/42 R |

*Primary Examiner*—G.E. McNeill
*Attorney, Agent, or Firm*—William W. Haefliger

[57] ABSTRACT

A hair roller employs a permanent and re-usable plastic sheet or film, one portion of the sheet attached to the roller to wind the remainder of the sheet on to the roller when the latter is turned; also, the remainder of the sheet includes sections sized to receive hair strands to be retained so as to be curled as the sections are wrapped in face to face relation about the roller; and at least one of the plastic sheet sections containing perforations to pass liquid hair treating agent.

7 Claims, 8 Drawing Figures

QUICK HAIR END WRAP FOR PERMANENT WAVE

BACKGROUND OF THE INVENTION

This invention relates generally to hair waving techniques and devices; more particularly it concerns the provision of a re-usable, non-disposable, rapidly usable hair end wrapping device, and its manner of use.

In the past, hair ends to be permanent waved have been confined in wrapped condition on hair rollers by means of disposable papers. The latter present numerous disadvantages among which are: the difficulty of applying the separate papers to a roller or rod; their lack of reusability; the extra steps or motions required in picking up the papers manually and manipulating them in relation to hair strands and a roller to achieve a desired wrap of the hair about the roller; and the added difficulty of handling the papers when soaked with hair treating agent.

SUMMARY OF THE INVENTION

It is a major object of the invention to provide a means to overcome the above problems and difficulties. Basically, the invention is embodied in the provision on a hair roller of a permanent and reusable plastic sheet or film, one portion of the sheet attached to the roller to wind the remainder of the sheet on to the roller when the latter is turned; also, the remainder of the sheet includes sections sized to receive hair strands to be retained so as to be curled as the sections are wrapped in face to face relation about the roller; and at least one of the plastic sheet sections containing perforations to pass liquid hair treating agent. As a result, the roller and attached hair retaining film may be used over and over, it is easy and quick to manipulate and use in relation to hair strands, and there is no sheet disposing problem.

Other objects and advantages include the provision of a sheet in the form of polyethylene film; the provision of folded sheet sections; the provision of a sheet loop to be received over the roller or into a slit in the roller, and the retention of the plastic sheet on a reduced dimension mid-portion of the roller between enlarged or flared roller ends, so as to be retained, when wound, by an elastic cord, as will be seen.

These and other objects and advantages of the invention, as well as the details of illustrative embodiments, will be more fully understood from the following description and drawings, in which:

DRAWING DESCRIPTION

DETAILED DESCRIPTION

Figure 1:
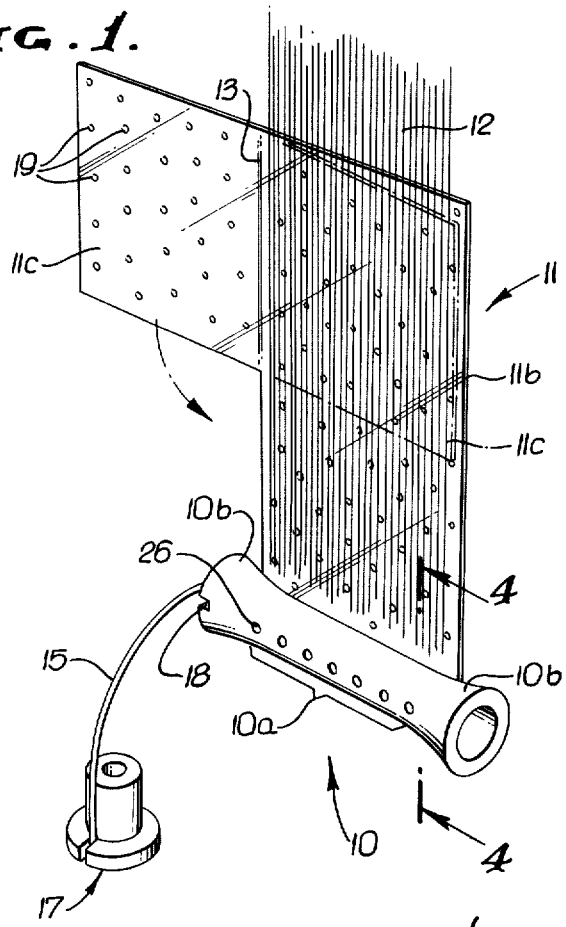
FIG. 1 is a perspective showing of one form of the invention.

The apparatus in FIG. 1 includes a cylindrical roller 10 which may comprise lightweight plastic material, and may have a reduced diameter portion 10*a* between somewhat enlarged flaring ends 10*b*, to provide wrapped hair storage space.

Figure 4:
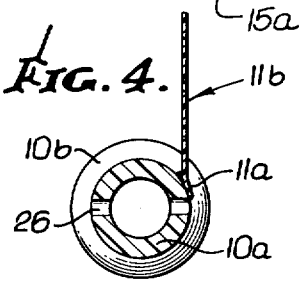
FIG. 4 is an enlarged section taken on lines 4—4 of FIG. 1.

A flexible plastic sheet or film 11 is provided, and a portion of the sheet is attached to the roller in such manner as to wind the remainder of the sheet onto the roller upon turning of the latter. For example, as seen in FIGS. 1 and 4, the end portion 11*a* may be suitably bonded to the mid-portion 10*a*, the remainder of the sheet then extending from the roller. That remainder includes sections, as at 11*b* and 11*c*, which are sized to receive hair stands 12 to be retained between the sections as indicated for example in FIG. 2. Note in this example that the sheet is folded as at edge 13 to define the sections 11*b* and 11*c*, the latter when folded into face to face relation retaining the hair strands to be curled as the sections are spiral wrapped about the roller mid-portion 10*a* in response to turning of the roller. Sheet 11 may for example consist of polyethylene film.

Figure 2:
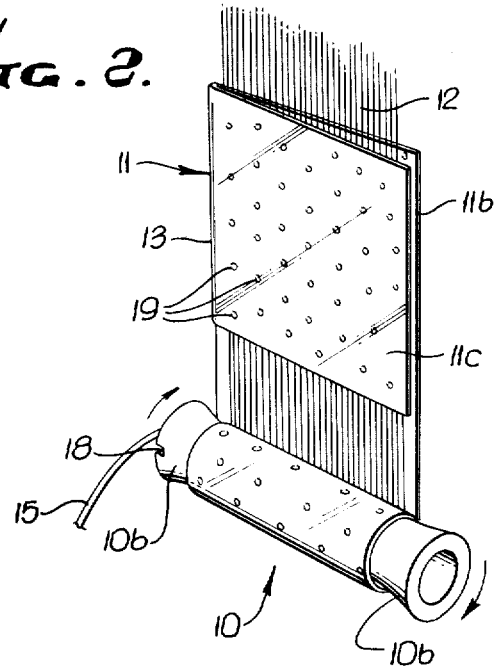
FIG. 2 is a view like FIG. 1, in an intermediate stage of application.
Figure 3:
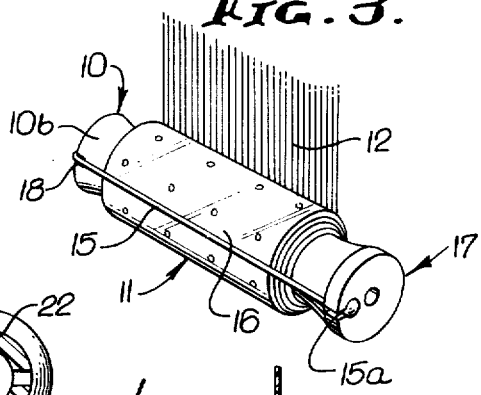
FIG. 3 is a view like FIG. 2, showing completion of application.

Means is provided for retaining the sheet wrapped on the roller. As illustrated in FIGS. 1–3, such means may advantageously include an elastic cord 15 extending in stretched condition between opposite ends 10*b* of the roller and closely adjacent the wrapped sheet extent designated at 16 in FIG. 3. In this regard, the roller may be elongated and cylindrical, and a plastic plug is illustrated at 17 as removably fitting into one end of the cylindrical roller. Further, one end of the band is attached to the plug as at 15*a*, the opposite end of the band fitting into a notch 18 in the roller end 10*b*, when stretched as in FIG. 3, so as to hold the spiral sheet wrapping in position.

At least one of the sheet sections 11*b* and 11*c* contains through perforations as at 19 to pass hair treating agent or liquid into contact with the retained hair, the liquid being suitably applied to the sheet section 11*c* as in FIG. 2 just prior to wrapping about the roller. Such treating agent may consist of any of various commercially known substances, in liquid form, as for example permanent wave set compound.

Figure 6:
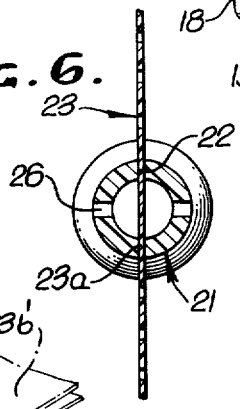
FIG. 6 is enlarged section taken on lines 6—6 of FIG. 5.
Figure 5:
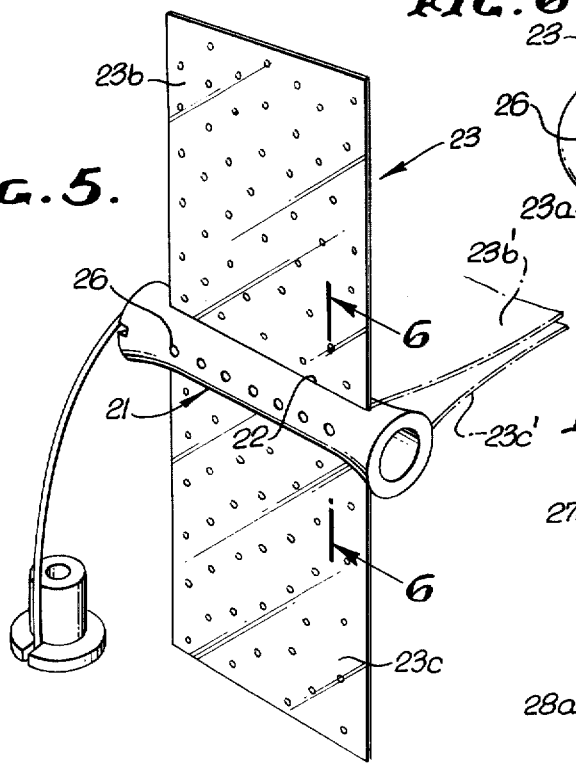
FIG. 5 is a perspective showing of a modified form of the invention.

In the modified form of the invention seen in FIGS. 5 and 6, the roller 21 contains a lengthwise extending slit 22 into which the end portion 23*a* of the plastic sheet or film 23 is received. The two sections 23*b* and 23*c* are sized to receive hair strands between them, for retention, when the sections are for example folded into the positions indicated at 23*b*′ and 23*c*′. In each of FIGS. 1 and 4–6, the roller is shown as containing a row of perforation 26. These operate to drain any excess liquid reagent into the hollow interior of the roller.

Figure 7:
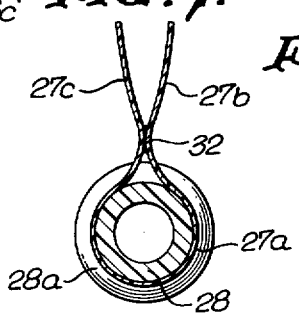
FIG. 7 is a view like FIG. 6 showing another form of the invention.
Figure 8:
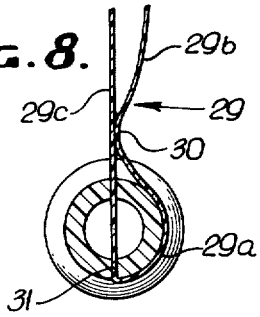
FIG. 8 is another view like FIG. 7 showing still another modification.

In FIG. 7, the plastic film sections 27*b* and 27*c* are locally bonded together at 32 to form a loop 27*a* defining that portion of the sheet which is attached to the roller 28. Note that the roller extends within the loop, the latter endwise confined between the enlarged flared ends 28*a* of the roller. In FIG. 8, a similar loop 29*a* is formed by locally bending sections 29*b* and 29*c* of the sheet 29 at 30. The loop is received in a slit 31 in the roller, for attachment thereto.

I claim:

1. In apparatus for retaining human hair to be waved, a. a tubular roller, having a side wall containing through perforations, and b. a flexible re-usable, plastic sheet having film thickness, one end-band portion of the sheet permanently attached to and integral with the roller along the major length thereof to wind the remainder of the sheet onto the roller upon turning thereof, the length of said band portion being less than the length of the roller, c. said sheet remainder including sections sized to receive hair strands to be retained therebetween and curled as the sections are wrapped in face to face relation about the roller in response to said turning, d. at least one section containing through perforations distributed substantially uniformly thereover to pass hair treating agent into contact with the hair retained between the sections, and e. an elastic cord extending in stretched condition between opposite ends of the roller and parallel to said end band, the roller being elongated and cylindrical, and a plug telescopically fitting one end of the roller and one end of said cord attached to the plug.

2. The apparatus of claim 1 wherein the plastic sheet consists of polyethylene film.

3. The apparatus of claim 1 wherein said end band portion is bonded to the roller outer surface.

4. The apparatus of claim 1 wherein the roller contains a lengthwise extending slit into which the sheet is received.

5. The apparatus of claim 2 wherein the sheet is folded to define said sections.

6. The apparatus of claim 5 wherein one section is attached to the roller, and the other section projects from a fold joining the two sections.

7. The apparatus of claim 3 wherein the sheet also extends into the roller.

* * * * *